US007997116B2

(12) United States Patent
Norin

(10) Patent No.: US 7,997,116 B2
(45) Date of Patent: Aug. 16, 2011

(54) LINK FOR CRIMPING TOOL

(75) Inventor: Mats Norin, Älvdalen (SE)

(73) Assignee: Pressmaster AB, Älvdalen (SE)

( * ) Notice: Subject to any disclaimer, the term of this patent is extended or adjusted under 35 U.S.C. 154(b) by 614 days.

(21) Appl. No.: 11/703,162

(22) Filed: Feb. 7, 2007

(65) Prior Publication Data

US 2007/0193330 A1 Aug. 23, 2007

(30) Foreign Application Priority Data

Feb. 21, 2006 (SE) ..... 0600378

(51) Int. Cl.
*B25B 7/12* (2006.01)
*B21J 9/18* (2006.01)

(52) U.S. Cl. ..... 72/409.11; 72/409.08; 72/450

(58) Field of Classification Search ..... 72/409.01, 72/409.07, 409.11, 409.09, 409.08, 450, 72/451, 402

See application file for complete search history.

(56) References Cited

U.S. PATENT DOCUMENTS

| | | | | |
|---|---|---|---|---|
| 2,933,000 | A * | 4/1960 | Wood | 72/402 |
| 2,991,675 | A * | 7/1961 | Ustin | 72/402 |
| 3,199,334 | A * | 8/1965 | Holmes et al. | 72/409.01 |
| 3,354,692 | A * | 11/1967 | Morris | 72/402 |
| 3,459,029 | A * | 8/1969 | Rosenfeld et al. | 72/409.01 |
| 4,158,302 | A * | 6/1979 | O'Loughlin | 72/409.16 |
| 5,509,291 | A | 4/1996 | Nilsson et al. | |
| 6,176,116 | B1 | 1/2001 | Wilhelm et al. | |
| 6,508,149 | B1 | 1/2003 | Heggemann et al. | |
| 7,503,201 | B2 * | 3/2009 | Cleland et al. | 72/409.1 |
| 2005/0076697 | A1 * | 4/2005 | Battenfeld | 72/409.12 |

FOREIGN PATENT DOCUMENTS

| | | |
|---|---|---|
| DE | 198 58 719 | 6/2000 |
| DE | 198 58 719 A1 | 6/2000 |
| GB | 2 010 729 A | 7/1979 |

OTHER PUBLICATIONS

Edgren et al., "Grip Force Vectors for Varying Handle Diameters and Hand Sizes" Human Factors, vol. 46, No. 2, pp. 244-251, Summer 2004.

* cited by examiner

*Primary Examiner* — Edward Tolan
*Assistant Examiner* — Mohammad Yusuf
(74) *Attorney, Agent, or Firm* — Dickstein Shapiro LLP

(57) ABSTRACT

The invention relates to a link for a crimping tool (2) comprising at least two crimping dies (12,14,16,18) and two tool handles (6,8), where the movable link (23) is arranged between the tool handles (6,8), the link (23) having an opening (72) arranged to engage a guide element (70) on a first handle (6) and being pivotally fixed to a second handle (8), where the guide element (70) is arranged to move from engagement with a first edge (71) of the opening (72) into engagement with a second opposite edge (73) of the opening (72) when the handles (6,8) are brought together to a position where the workpiece (19) is engaged by the crimping dies (12,14,16,18), the link (23) thus enabling the person using the crimping tool (2) to utilize the optimum gripping range of the hand that is about to exert a large force on the handles (6,8) in order to bring them further together for the crimping of the workpiece (19), this regardless of the dimension of the workpiece (19) to be crimped.

4 Claims, 9 Drawing Sheets

LINK FOR CRIMPING TOOL

FIELD OF THE INVENTION

The present invention relates to a link for a crimping tool.

BACKGROUND OF THE INVENTION AND RELATED ART

Cable termination tooling may comprise e.g. cutting tools, stripping tools and crimping tools. Some tools only have one of the above functions, whereas other tools have two or three of the above functions. Tools for cable termination may be hand tools or powered tools, e.g. hydraulically powered tools. Cable termination is required e.g. for connecting a cable or a wire to power, coaxial, fiber-optic or modular connectors.

When crimping, a connector i.e. a terminal, splice, contact or a similar device is mechanically secured to a cable—e.g to a conductor such as a wire—by deformation so that a solid joint having reliable mechanical and electrical connection is formed. The crimping operation resulting in a crimped joint is e.g. performed using crimping dies.

DE 198 58 719 A1 shows a crimping tool having an two-part-frame for adjusting the position of the crimping dies which crimping dies are pivotally mounted and axially fixed to the body of the crimping tool, i.e. the pivot points for the crimping dies are fixed relative to the body of the tool. Thus, a sliding movement occurs on the contact surface between the crimping dies and the workpiece to be crimped during the crimping operation.

SUMMARY OF THE INVENTION

The primary object of the present invention is to provide an improved link for a crimping tool, said link cooperating with an improved crimping die in an improved crimping tool for guiding the movement of the crimping dies relative to the body of the tool. The movable link is arranged between the tool handles, the link enabling the person using the crimping tool to utilize the optimum gripping range of the hand that is about to exert a large force on the handles in order to bring them further together for the crimping of the workpiece, this regardless of the dimension of the workpiece to be crimped.

The above mentioned object is achieved for a device having the features stated in claim 1.

These and other advantageous features will be apparent from the detailed description below.

The invention will now be described in more detail below with reference to the appended drawings which illustrate preferred embodiments of the device according to the invention.

DESCRIPTION OF PREFERRED EMBODIMENTS

Figure 1:
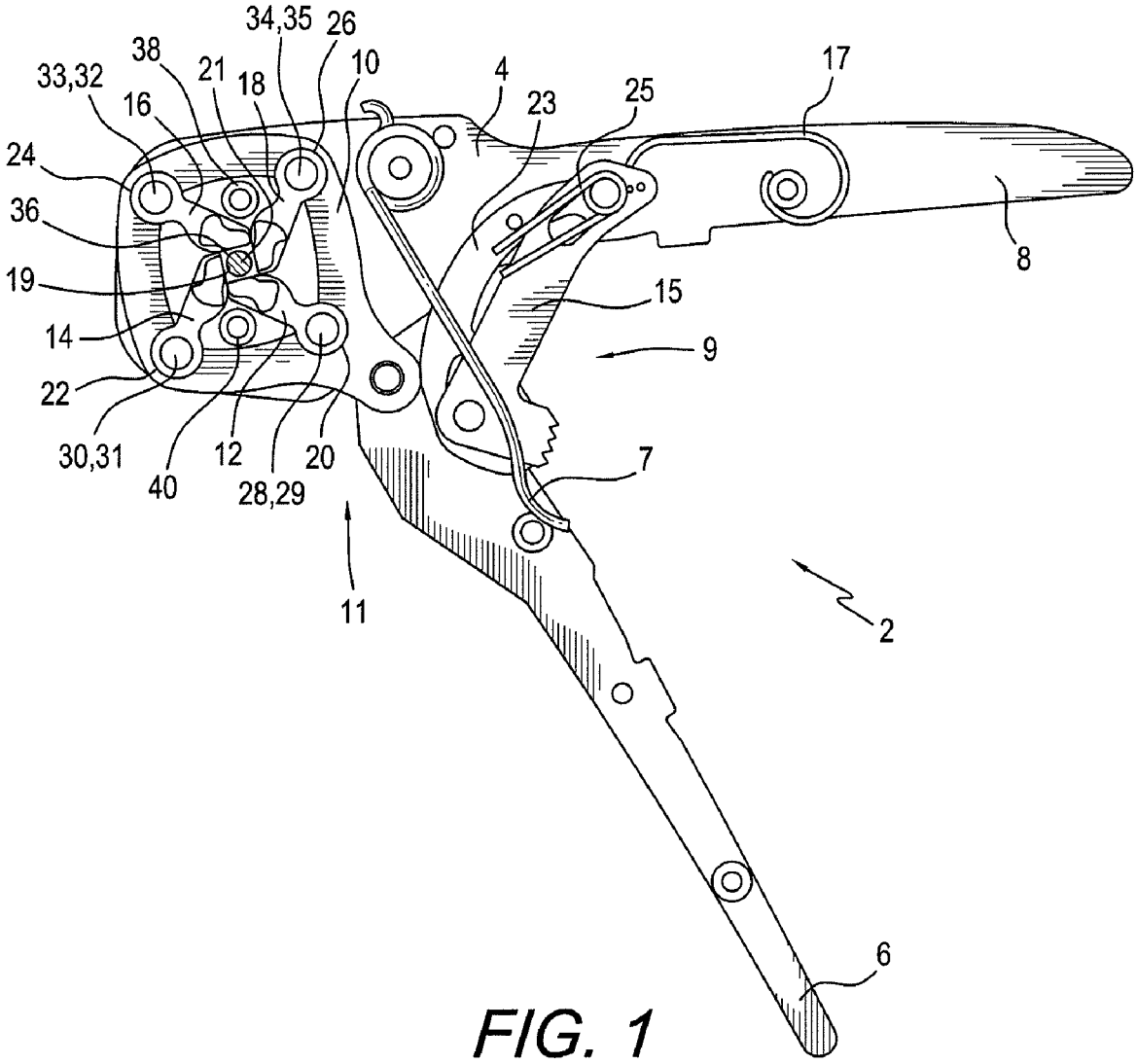
FIG. 1 shows schematically a side view of a crimping tool according to the invention in open position, i.e. before the beginning of the crimping stroke.

The same reference numerals are being used for similar features in the different drawings.

FIG. 1 shows schematically a side view of a crimping tool 2 according to the invention in an open position, i.e. before the beginning of the crimping stroke. The crimping tool 2 comprises a body 4, a first handle 6 and a second handle 8. The first handle 6 and the second handle 8 are movable relative to another, i.e. pivotally interconnected by a mechanism 9. The second handle 8 is integrated in the body 4 in this embodiment, but it may alternatively be movable relative to the body 4. The crimping tool further comprises a linkage 11 comprising a guide plate 10 and at least three crimping dies, in this embodiment four crimping dies 12,14,16,18, movable relative to one another, movable relative to the guide plate 10, and movable relative to the body 4, i.e which are guided for displacement in the crimping tool 2. The crimping dies 12,14,16,18 are pivotally mounted and axially fixed, preferably near their respective ends 20,22,24,26, on the guide plate 10 using pins 28,30,32,34 arranged preferably perpendicular to the plane of the guide plate 10. This results in the pins 28,30,32,34 and thus the pivot points 29,31,33,35 of the crimping dies 12,14,16,18 being movable relative to the body 4 of the tool 2 as the guide plate 10 is arranged to be movable relative to the body 4 of the crimping tool 2. This will be further shown in FIG. 3. Further, a return spring 7 is shown which spring 7 presses apart the first handle 6 from the second handle 8. A toothed segment 15 is pressed by a second spring 17 away from the second handle 8 thus allowing a link 23 to be freely pressed by a third spring 25 against the end of the guide plate 10.

Figure 2:
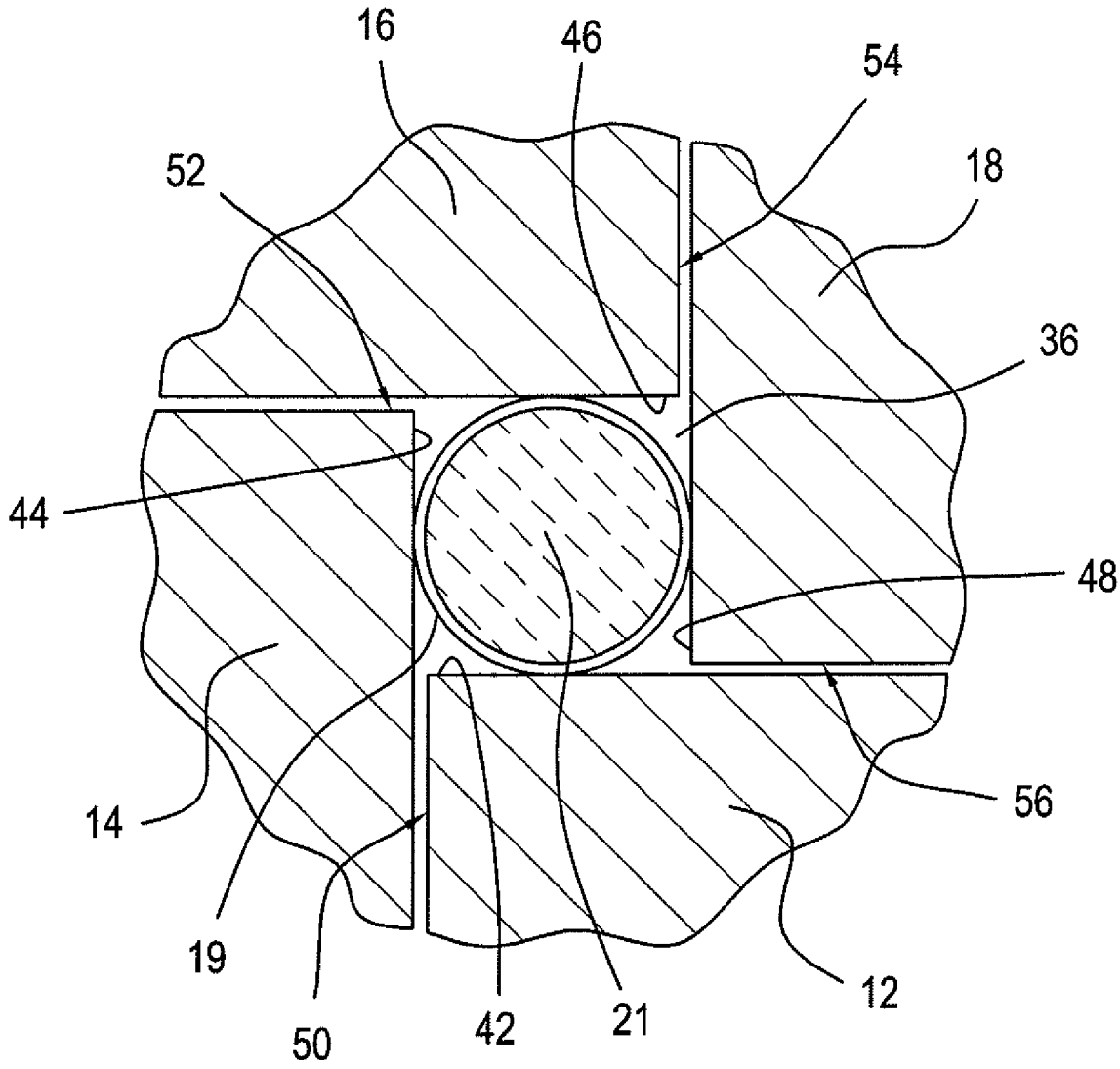
FIG. 2 shows the four crimping dies shown in FIG. 1 in an exploded view.

FIG. 2 shows the four crimping dies 12,14,16,18 shown in FIG. 1 in an exploded view. The four crimping dies 12,14,16,18 delimit an opening 36, in this embodiment a square opening, between them. By rotating the guide plate 10 clockwise, the movement of the guide plate 10 being enabled by at least two distance members 38,40 arranged on the body 4 of the crimping tool 2, the opening 36 will close as will be further shown in FIG. 3. A workpiece 19 to be crimped is inserted into the opening 36 delimited by the crimping dies 12,14,16,18 whereafter a cable 21, e.g. a stripped portion of a wire, is then inserted into the workpiece 19 to be crimped. This will be discussed more in detail below.

Figure 3:
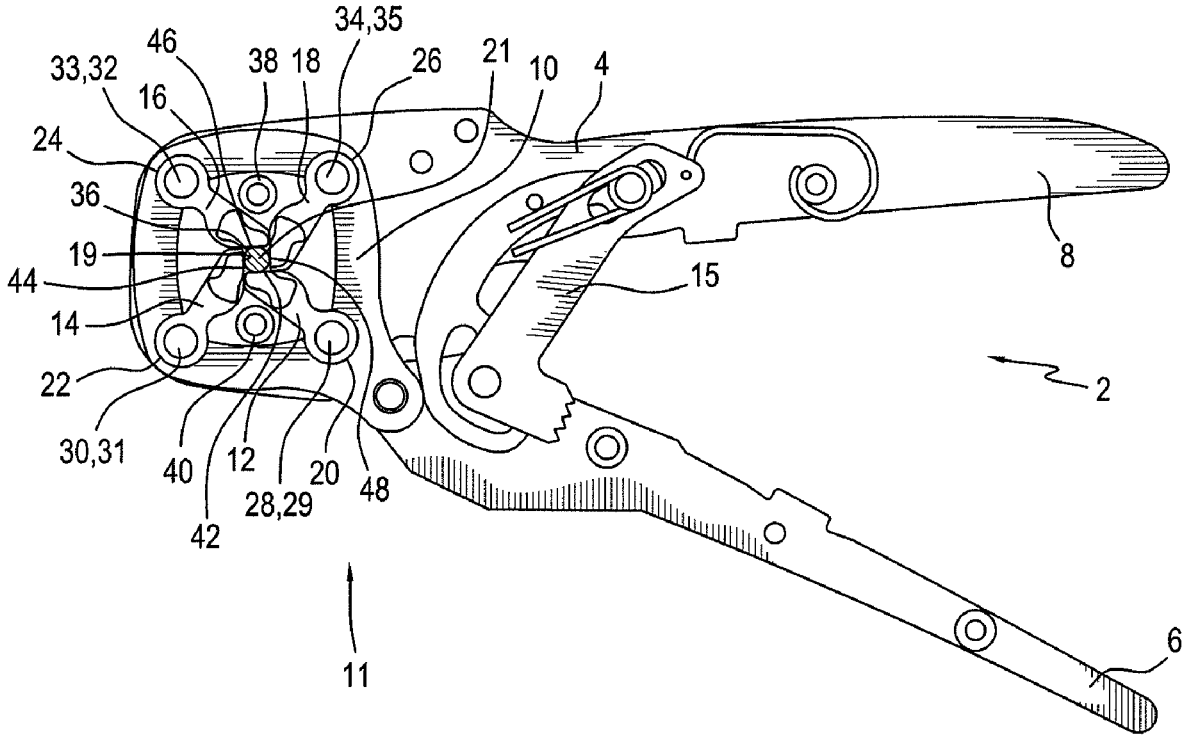
FIG. 3 shows schematically the crimping tool according to FIG. 1 in a closed position, i.e. after the crimping stroke.

FIG. 3 shows schematically the crimping tool according to FIG. 1 in a closed position, i.e. after the crimping stroke. The crimping tool 2 comprises, as mentioned above, a body 4, a first handle 6 and a second handle 8. The crimping tool further comprises a guide plate 10 and in this embodiment four crimping dies 12,14,16,18. A workpiece 19 to be crimped is inserted into the opening 36 delimited by the crimping dies 12,14,16,18. Thereafter, when the handles 6,8 are brought together, the guide plate 10 is rotated clockwise while the movement of the guide plate 10 being enabled by at least two distance members 38,40 arranged on the body 4 of the crimping tool 2. The movement of the guide plate 10 results in the movement of the pivot points 29,31,33,35 of the crimping dies 12,14,16,18 relative to the body 4 of the tool 2 and at the same time the closing of the opening 36 and crimping the workpiece 19. The closing of the opening 36 is performed in the following way by co-operating crimping dies 12,14,16,18: Now referring back to FIG. 2, each of the four crimping dies 12,14,16,18 have a respective crimping surface 42,44,46,48 and a respective sliding surface 50,52,54,56 each of which surfaces preferably are substantially straight, said respective crimping surface 42,44,46,48 and sliding surface 50,52,54,56 forming angles, preferably right angles when having four crimping dies 12,14,16,18, with one another. The sliding surface 50,52,54,56 of each crimping die 12,14,16,18 is in sliding contact with the adjacent crimping surface 42,44,46,48 of an adjacent crimping die 12,14,16,18. As will be further described below, when the guide plate 10 is rotated clockwise, the said sliding surfaces 50,52,54,56 slide against the said respective adjacent crimping surfaces 42,44,46,48 thus maintaining the shape, e.g. square shape, of the cross-section of the opening 36 delimited by the dies 12,14,16,18 as the opening 36 closes. The crimping dies 12,14,16,18 thus form a die profile of closed shape in all crimping positions. All crimping dies 12,14,16,18 thus actively take part in the crimping action. As can be seen in FIG. 3, the guide plate 10 and the pivot points 29,31,33,35 of the crimping dies 12,14,16,18 have moved relative to the body of the tool 2 when the handles 6,8 have been brought together to the closed position of the tool 2, i.e. when the first handle 6 is fully closed to the second handle 8, compared with the position of the guide plate 10 and the pivot points 29,31,33,35 of the crimping dies 12,14,16,18 as shown in FIG. 1 showing the open position of the tool 2. These movable pivot points produce a rolling movement between the pivot points 29,31,33,35 of the crimping dies 12,14,16,18 and the body 4 of the crimping tool 2, whereby the crimping surfaces 42,44,46,48 of the crimping dies 12,14,16,18 are made to act on the workpiece 19 to be crimped without the crimping dies 12,14,16,18 sliding on the surface of the body 4 of the tool 2 thereby decreasing the wear between the crimping dies 12,14,16,18 and the body 4 of the tool 2. If the pivot points would have been fixed relative to the body of the tool, this would have resulted in a sliding movement on the contact surface between the crimping dies and the body of the tool, and thus in more wear between them. It can be seen how the toothed segment 15 has moved during the crimping operation.

Figure 4:
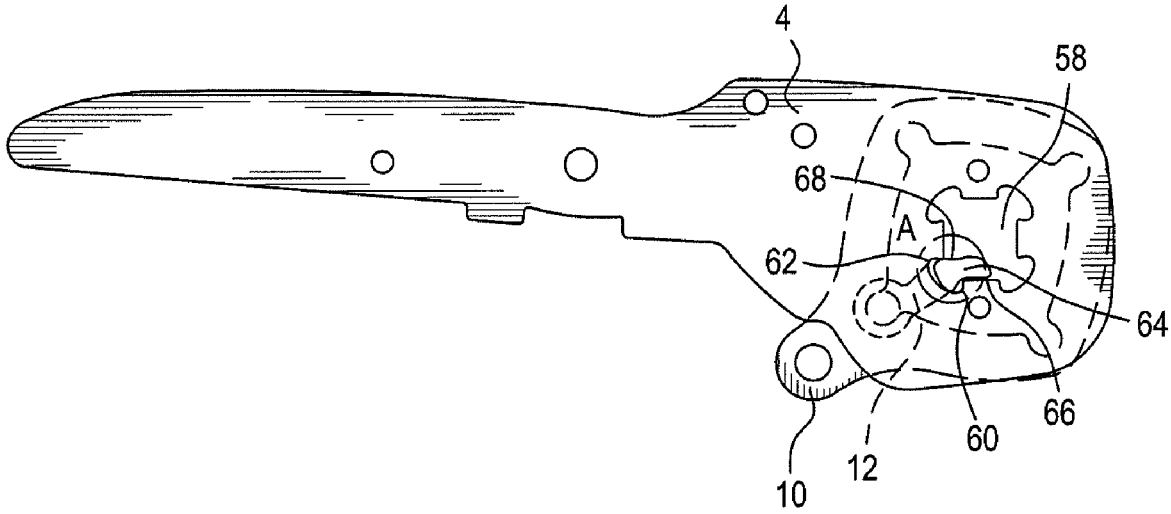
FIG. 4 shows schematically the body of the tool.

FIG. 4 shows schematically the body 4 of the tool, the body 4 having an opening 58 comprising tooth flanks 60,62 for a crimping die 12. Similar tooth flanks are arranged for all crimping dies 12,14,16,18. A crimping die 12 and the guide plate 10 are also shown. A shoulder 64 protruding from the crimping die 12 and formed with tooth flanks 66,68 can be seen arranged in the opening 58 in the body 4. The tooth flanks 66,68 on the shoulder 64 on the crimping die 12 cooperates with the tooth flanks 60,62 in the body 4 of the tool when the guide plate 10 is rotated clockwise or anti-clockwise thus keeping the sliding surface 50,52,54,56 of each crimping die 12,14,16,18 in sliding contact with the adjacent crimping surface 42,44,46,48 of an adjacent crimping die 12,14,16,18 (see FIG. 2).

Figure 5:
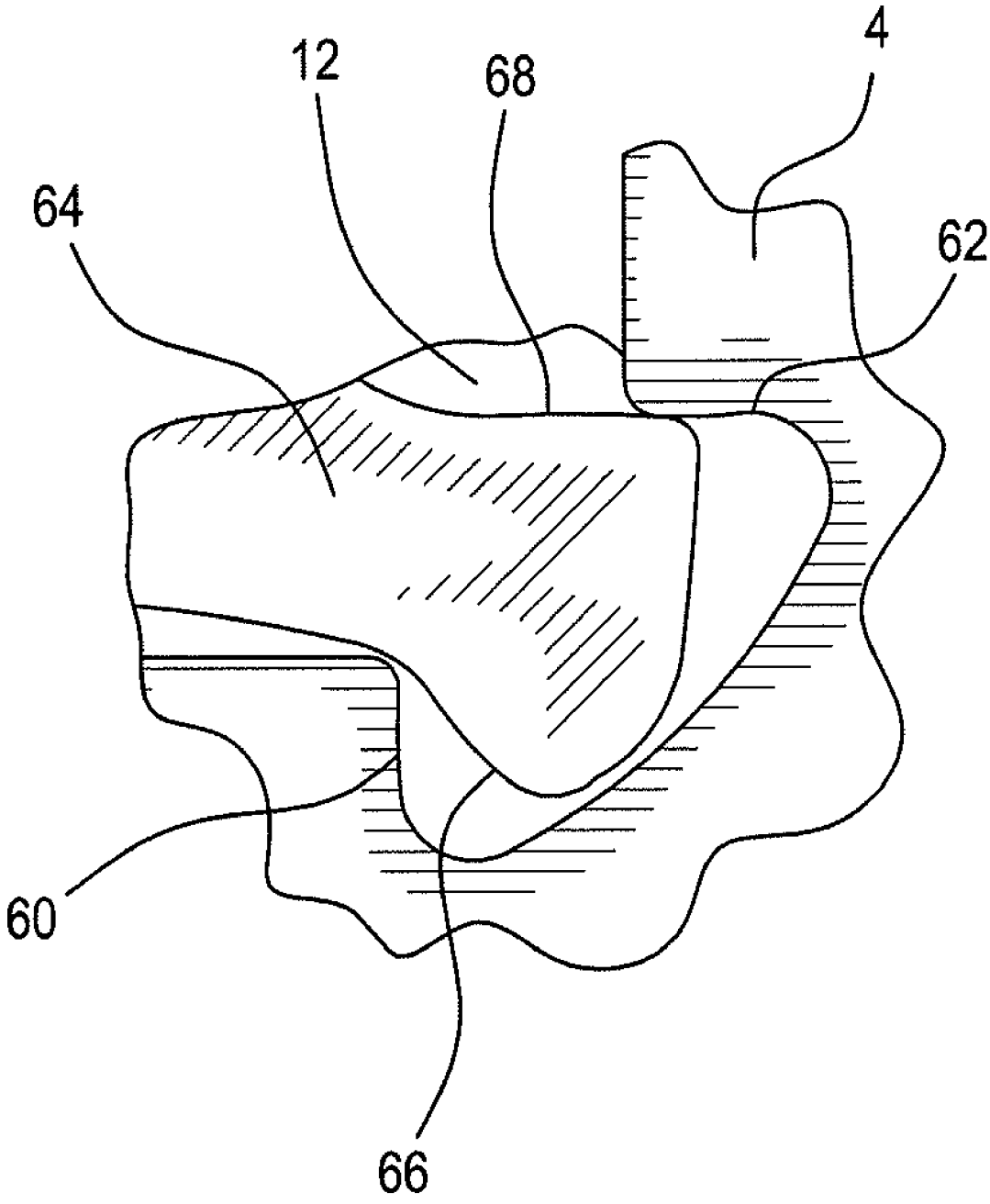
FIG. 5 shows schematically the cooperation between the tooth flanks on body and die.

FIG. 5 shows schematically the cooperation between the two tooth flanks 60,62 on the body 4 and the two tooth flanks 66,68 on the protruding shoulder 64 of the crimping die 12. When the guide plate 10 is rotated clockwise, the first tooth flanks 60,66 cooperate. When the guide plate 10 is rotated anti-clockwise, the second tooth flanks 62,68 cooperate in a similar manner. Thus, the crimping dies 12,14,16,18, i.e. their tooth flanks 66,68, do not slide on the surface, i.e. on the tooth flanks 60,62, of the body 4 of the tool 2 thereby decreasing the wear between the crimping dies 12,14,16,18 and the body 4 of the tool 2.

When the guide plate 10 is rotated counterclockwise, the opening 36 is opened thus releasing the crimped workpiece 19 from the crimping tool 2.

As has been mentioned above, the crimping dies 12,14,16,18 are pivotally mounted and axially fixed, preferably near their respective ends 20,22,24,26, on the guide plate 10 using pins 28,30,32,34 arranged preferably perpendicular to the plane of the guide plate 10. Arranging the pins 28,30,32,34 through the respective ends 20,22,24,26 of the crimping dies 12,14,16,18, gives the advantage of a longer curve for the crimping surfaces 42,44,46,48 of the respective crimping dies 12,14,16,18, thus giving smaller clearance between the said sliding surfaces 50,52,54,56 and the said respective adjacent crimping surfaces 42,44,46,48.

The invention relates to a link for crimping tool 2 comprising at least two crimping dies 12,14,16,18, where the movable link 23 is. arranged between the tool handles 6,8, the link 23 having an opening 72 arranged to engage a guide element 70 on a first handle 6 and being pivotally fixed to a second handle 8.

FIG. 6-9 shows schematically the crimping tool according to FIG. 1 without the toothed segment 15 for better understanding of how the link 23 operates.

Figure 6:
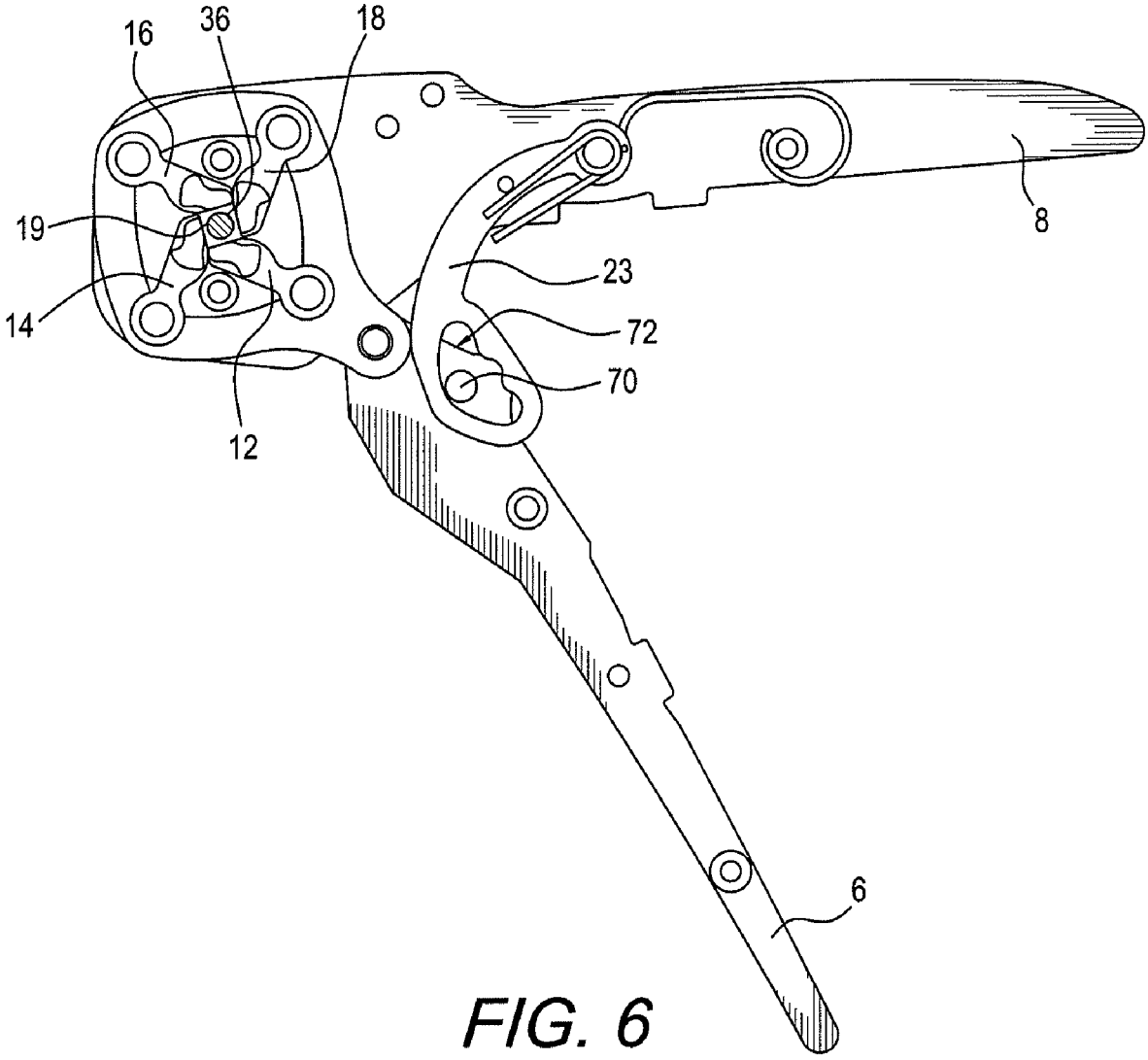
FIG. 6-9 shows the crimping tool according to FIG. 1 without the toothed segment.

The crimping tool 2 operates in the following manner:

FIG. 6 shows that the first handle 6 is provided with a guide element 70 and that the link 23 has an opening 72 wherein said guide element is engaged thus controlling the area of movement of the link 23 relative to the first handle 6. Firstly, a workpiece 19 to be crimped such as a connector or a similar device is inserted into the opening 36 delimited by the crimping dies 12,14,16,18.

Figure 7:
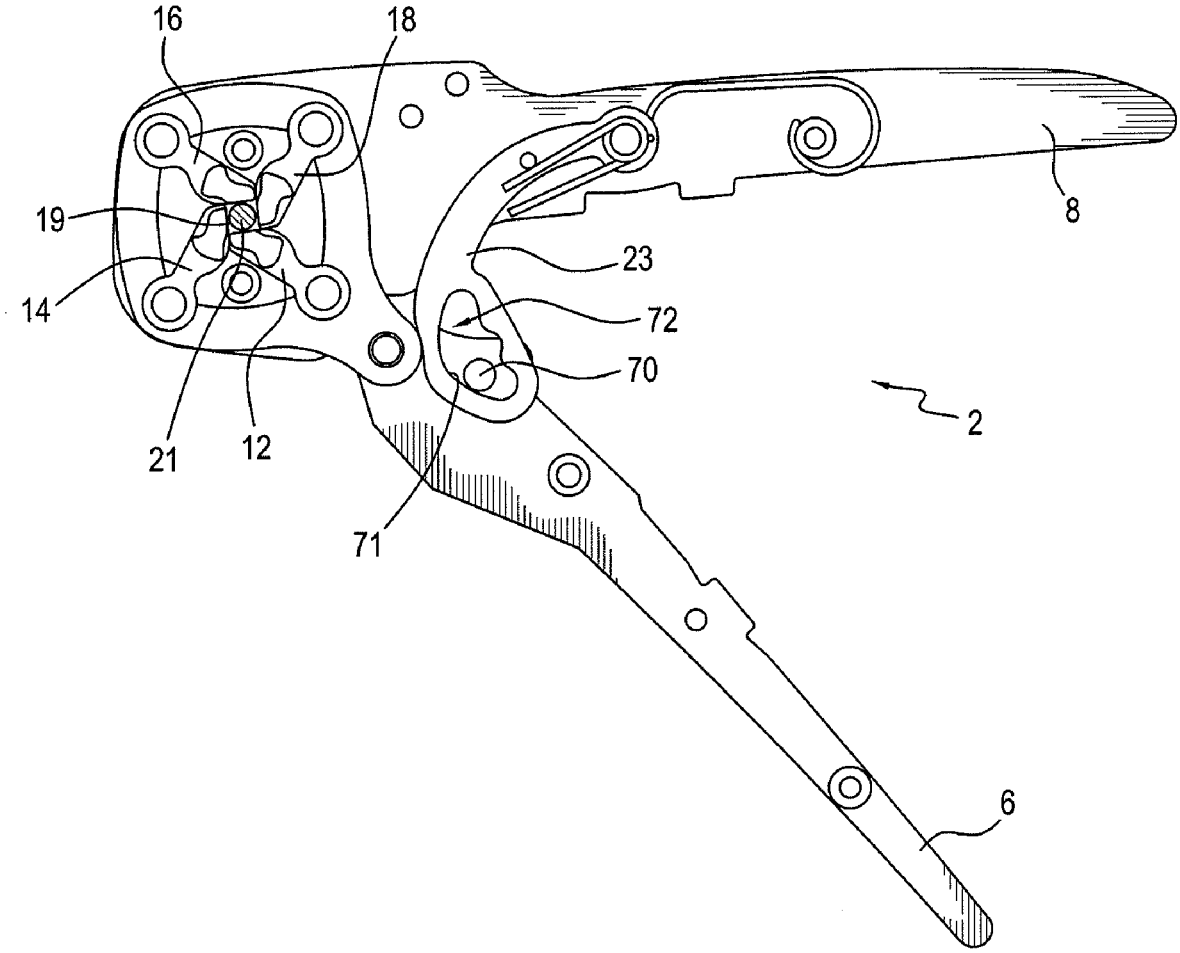

FIG. 7 shows that after insertion of the workpiece 19, the crimping tool 2 is operated by gently squeezing the handles 6,8 together making the crimping dies 12,14,16,18 move slightly against each other thereby coming into contact with and exerting pressure on the workpiece 19 to be crimped so that the workpiece 19 to be crimped is held in place without being deformed. This enables easy insertion of a cable 21, e.g. a stripped portion of a wire, into the workpiece 19 to be crimped. As can be seen, the guide element 70 arranged on the first handle 6 has moved relative to the link 23 along a first edge 71 of the opening 72.

Figure 8:
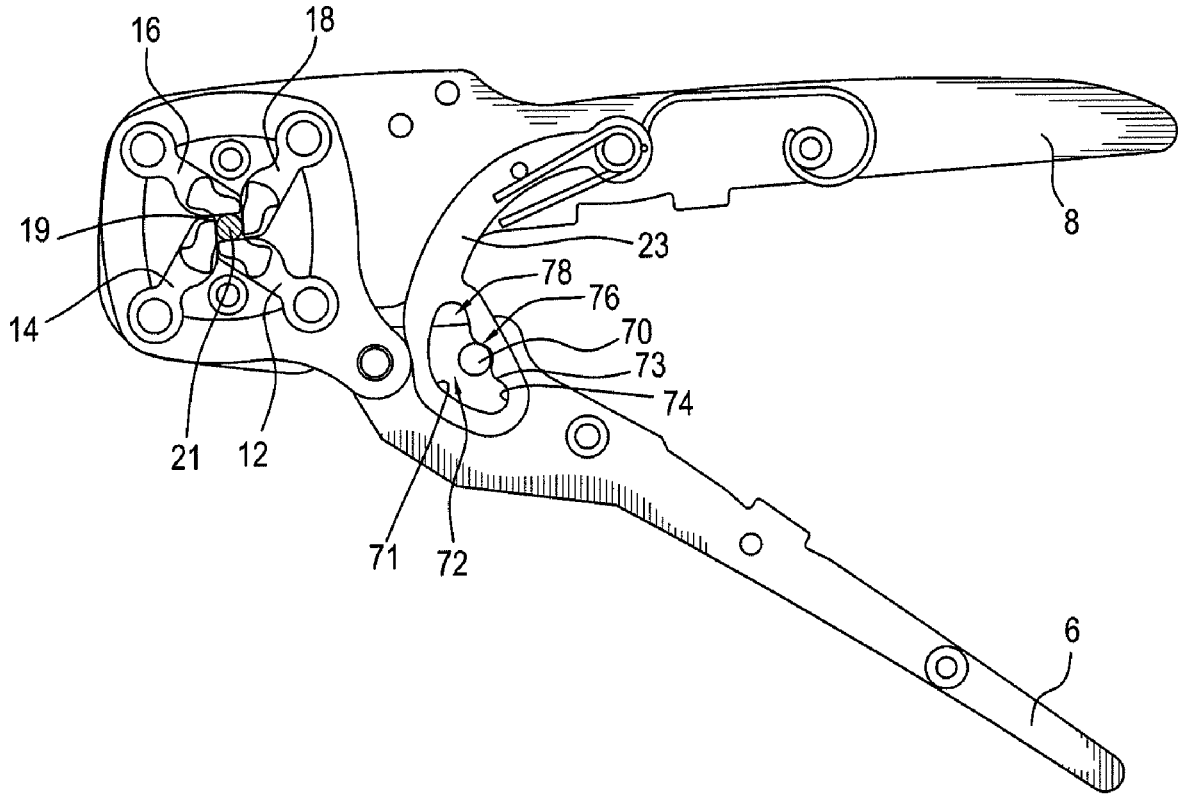

FIG. 8 shows that when the workpiece 19 and the cable 21 are aligned in a satisfactory way, the handles 6,8 are further squeezed together which makes the crimping dies 12,14,16,18 move against each other, and also makes the guide element 70 arranged on the first handle 6 to move into a recess 76, said recess 76 corresponding to a medium-range dimension of workpiece 19, on the other side of the opening 72 in the link 23. The guide element 70 is thus arranged to move from engagement with a first edge 71 of the opening 72 into engagement with a second opposite edge 73 of the opening 72 when the handles 6,8 are brought together to a position where the workpiece 19 is engaged by the crimping dies 12,14,16,18. As can be seen, in this embodiment three recesses 74,76,78 are arranged at the edge of the opening corresponding to three different ranges of workpiece 19 cross-section dimensions. The link 23 thus enables the person using the crimping tool 2 to utilize the optimum gripping range of the hand that is about to exert a large force on the handles 6,8 in order to bring them further together for the crimping of the workpiece 19, this regardless of the dimension of the workpiece 19 to be crimped. The optimum gripping range referred to above refers to the range of positions of the fingers of the hand where the hand and the fingers may exert the maximum force when the hand is clenched further together. This optimum gripping range is to be found in tables known in the art (see e.g. the article "Grip force Vectors for Varying Handle Diameters and Hand Sizes", HUMAN FACTORS, Vol. 46, No. 2, Summer 2004, pp 244-251, Human factors and Ergonomics Society).

Figure 9:
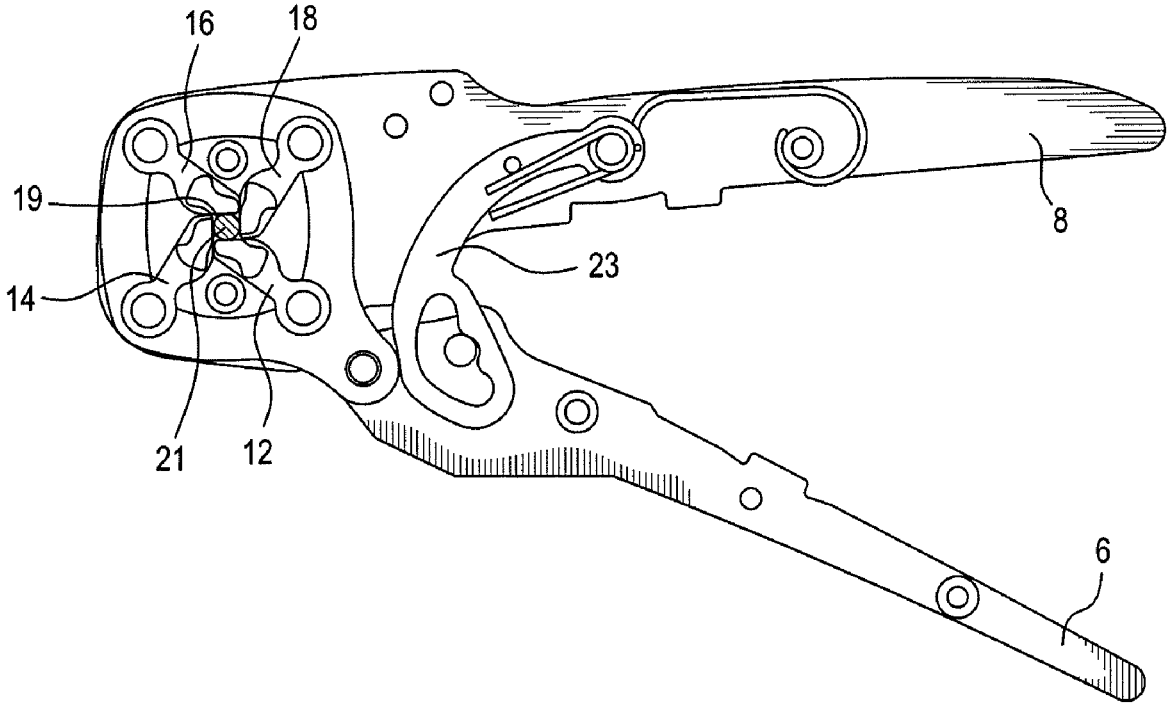

FIG. 9 shows that when the handles 6,8 are brought further together, this results in a crimped joint, in this embodiment with a square cross-section, with the workpiece 19 crimped about the cable 21. As can be seen, the link 23 is somewhat elastically deformed when the handles are brought further together, thus acting as a spring balancing the forces between the handles 6,8 and the crimping dies 12,14,16,18 in order to compensate for different dimension of the workpiece 19 which is within the ranges of workpiece 19 cross-section dimensions corresponding to the recess 74,76,78, recess 76 in this case.

Finally the handles 6,8 are released which in turn moves the crimping dies 12,14,16,18 apart thereby allowing removal of the crimped connector 19 from the crimping tool 2.

The invention claimed is:

1. A link for a crimping tool comprising at least two crimping dies; and first and second handles wherein the link is movably arranged between the first and second handles, the link having an opening arranged to engage a guide element on the first handle and being pivotally fixed to the second handle, wherein the guide element is arranged to automatically move from engagement with a first smooth edge of the opening into engagement with a second opposite edge of the opening when the first and second handles are brought together to a position where a workpiece is engaged by the crimping dies, the second edge having at least one recess situated between longitudinal ends of the opening, the guide element moving into the at least one recess or into either end of the opening, depending on a dimension of the workpiece, the link thus automatically making the first and second handles take substantially same mutual positions regardless of the dimension of the workpiece to be crimped when an actual crimping process is initiated.

2. The link according to claim 1, wherein the link is elastically deformable, thus acting as a spring balancing the forces between the first and second handles and the crimping dies when the guide element is in a recess at the second edge of the opening and the first and second handles are brought further together, in order to compensate for different dimensions of the workpiece within said workpiece cross-section dimension range.

3. A crimping tool comprising:

a first handle having a guide element;

a second handle;

at least two crimping dies that are guided for displacement in the crimping tool, wherein each of the crimping dies have a respective crimping surface, wherein the crimping surfaces together form a crimping opening; and a link being movably arranged between the first and second handles, the link having an opening arranged to engage the guide element on the first handle and being pivotally fixed to the second handle, wherein the guide element is arranged to automatically move from engagement with a first smooth edge of the opening into engagement with a second opposite edge of the opening when the first and second handles are brought together to a position where a workpiece is engaged by the crimping dies, wherein the second edge has at least one recess situated between longitudinal ends of the opening, the guide element moving into the at least one recess or into either end of the opening, depending on a dimension of the workpiece, the link automatically making the first and second handles take substantially same mutual positions regardless of the dimension of the workpiece to be crimped when an actual crimping process is initiated.

4. The crimping tool according to claim 3, wherein the link is elastically deformable to act as a spring, balancing the forces between the first and second handles and the crimping dies when the guide element is in a recess at the second edge of the opening and the first and second handles are brought further together, in order to compensate for different dimensions of the workpiece within the workpiece cross-section dimension range.

* * * * *